United States Patent [19]

Hardy

[11] 4,244,266

[45] Jan. 13, 1981

[54] DRUMHEAD DEADENING DEVICE

[75] Inventor: Bruce N. Hardy, Elkhart, Ind.

[73] Assignee: Silver Street, Incorporated, Elkhart, Ind.

[21] Appl. No.: 56,021

[22] Filed: Jul. 9, 1979

[51] Int. Cl.[3] ..... G10D 13/02

[52] U.S. Cl. ..... 84/411 M; 84/414

[58] Field of Search ..... 84/411–422

[56] References Cited

U.S. PATENT DOCUMENTS

| | | | |
|---|---|---|---|
| 2,495,451 | 1/1950 | Gladstone | 84/411 M |
| 3,026,759 | 3/1962 | Kleiner et al. | 84/411 R |
| 3,250,169 | 5/1966 | Stone et al. | 84/417 X |

FOREIGN PATENT DOCUMENTS

| | | | |
|---|---|---|---|
| 944588 | 4/1949 | France | 84/411 M |
| 8119 | of 1887 | United Kingdom | 84/414 |

*Primary Examiner*—Lawrence R. Franklin

*Attorney, Agent, or Firm*—Marmaduke A. Hobbs

[57] ABSTRACT

A drumhead deadening device in which a body of porous, pliable material has an adhesive layer on one surface and the adhesive layer is used to attach the body to a drumhead membrane. An opening is disposed in the body to correspond with the preferred attack area of the drum membrane. When the device is secured to the membrane, the material with the opening therein does not substantially interfere with the initial vibrations induced when the drum membrane is struck by the drummer; however, the material does absorb the reflected vibrations which return toward the center of the drum after having been reflected by the rim of the drum, thus substantially minimizing the ringing phenomenon associated with synthetic drumheads. The body may be annular, or of other shapes, and in a variety of different colors.

8 Claims, 6 Drawing Figures

Fig. 1
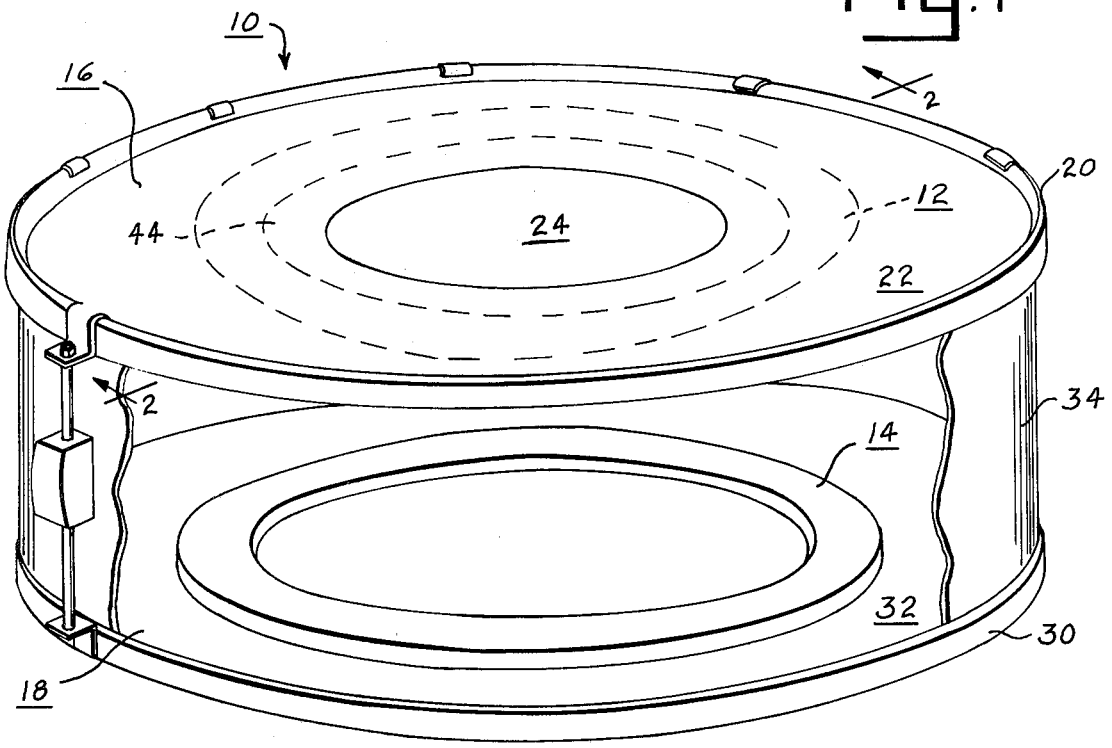
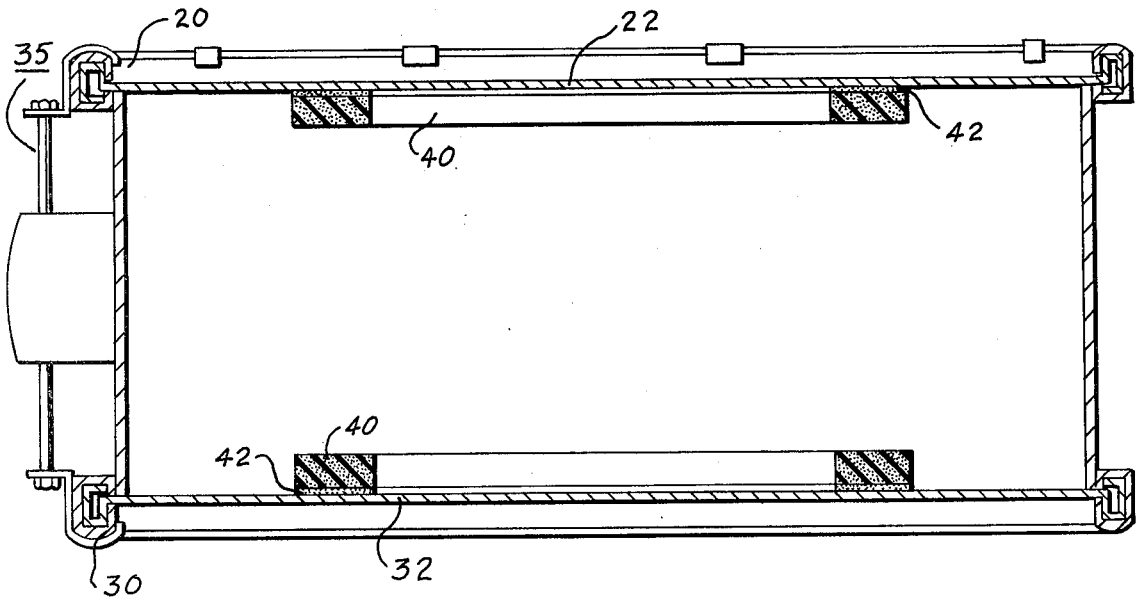
Fig. 2

Fig. 3
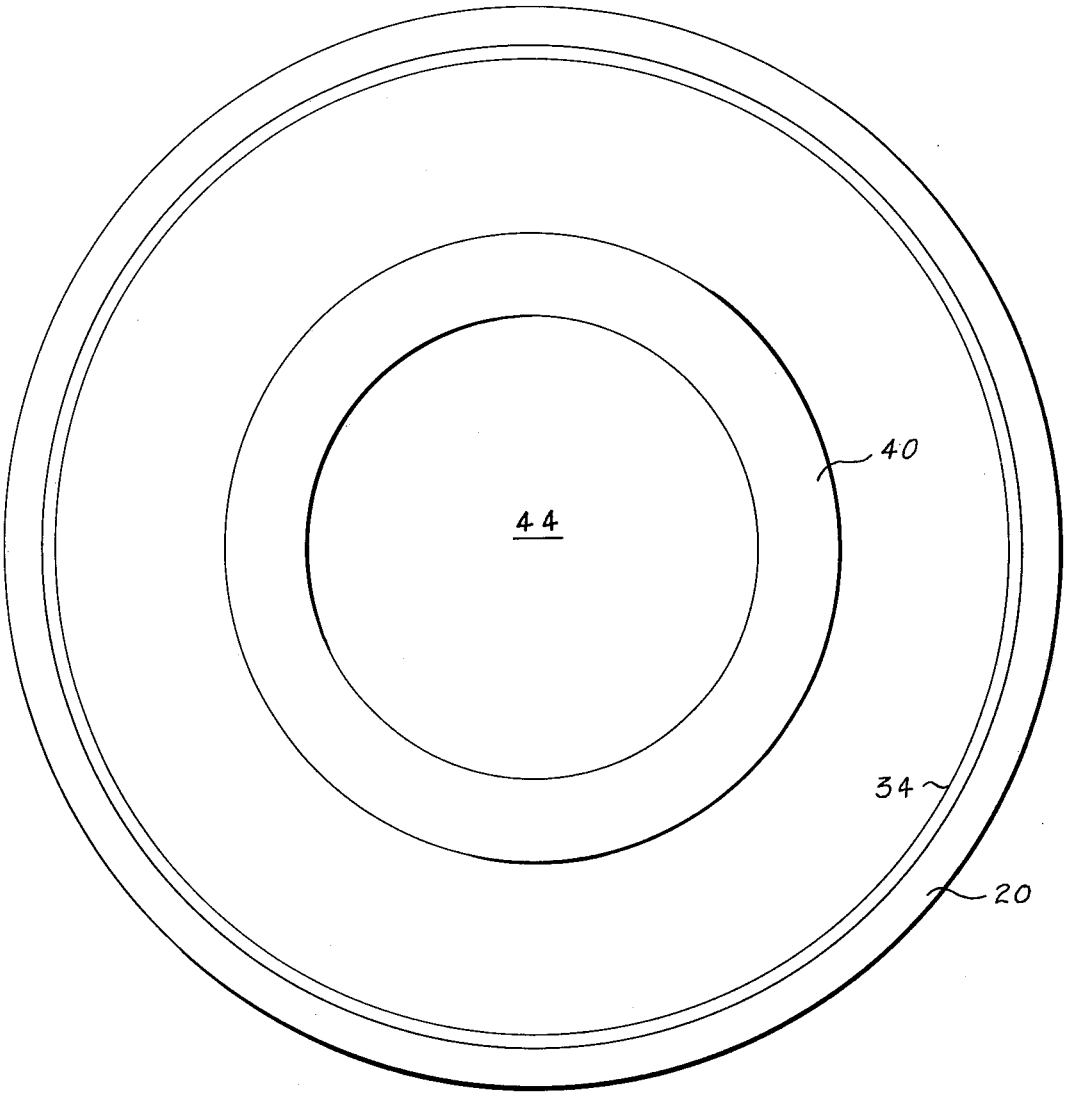
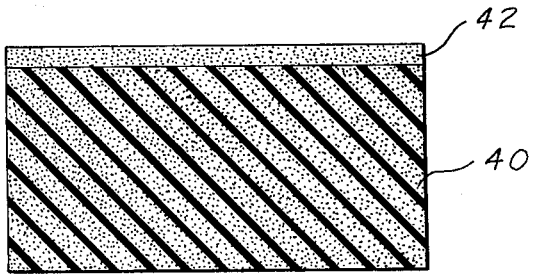
Fig. 6

Fig. 4
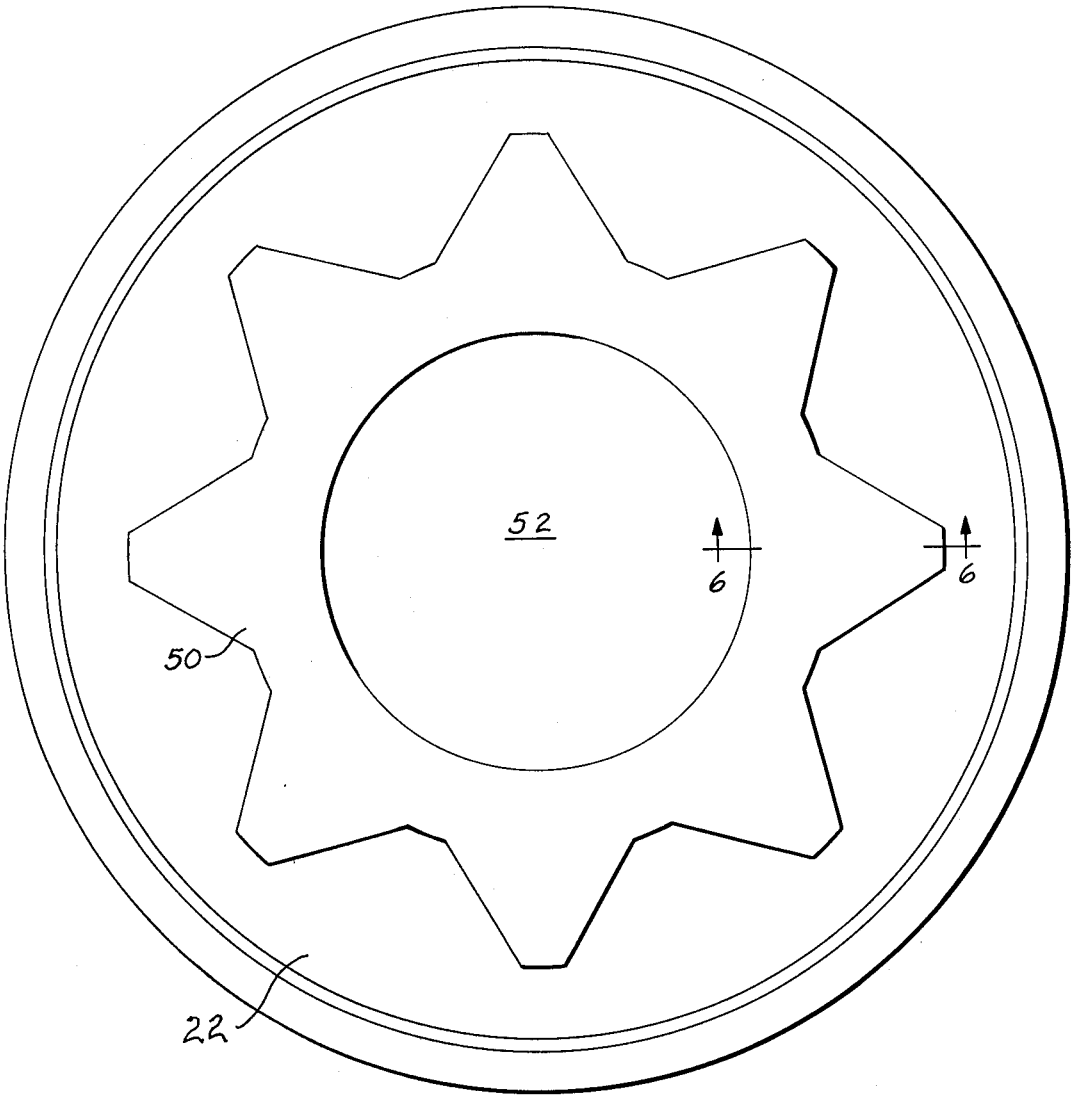
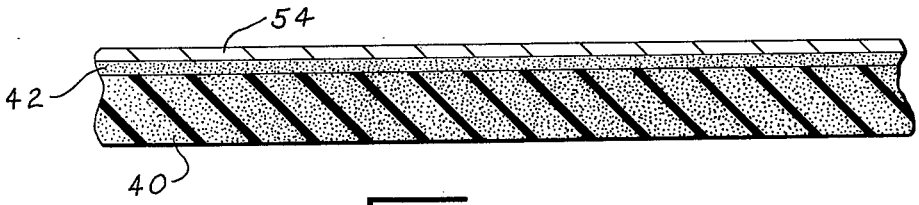
Fig. 5

DRUMHEAD DEADENING DEVICE

Due to the recent increased popularity of plastic and other synthetic drumheads, a phenomenon known as "ringing" has come to be a problem for drummers. One theory of the cause of ringing is that the vibrations of a plastic drumhead, which result when the drum is struck by the drummer, move radially outwardly toward the edge or rim of the drum, reach the periphery thereof, and are reflected back by the rim. As the reflected vibrations are returning toward the center of the drum, if the drum is struck again, the most recently induced vibrations, which, at this point, are traveling outwardly, will meet the returning reflected vibrations from the previous beat. It is the meeting and crossing of vibrations which causes the effect known as ringing. The crossing vibrations, and resultant sound waves, produce a distorted drum tone which varies in pitch; hence, the term ringing. This phenomenon was not as severe a problem when drumheads were made principally of natural products such as calfskin or other "gut" type materials which do not conduct the reflected vibrations as efficiently as do the synthetic drumhead membranes.

Since the relatively recent advent of the use of plastic and synthetic drumheads, and the accompanying increase in the ringing phenomenon, drummers have searched for methods of reducing or eliminating this problem, in an effort to achieve a more pure percussive tonal quality. It has been found that placing pillows, rugs, or other materials inside the drum shell and in contact with the drumhead, will reduce the amount of return vibration, thereby reducing the ringing phenomenon. Although moderately effective, the use of such materials in the drum shell is inconvenient, unsightly and impractical for drums which are to be carried by marching band members or the like. Large bulky items, such as pillows or rugs, when stuffed in the drum shell, also retard the originating vibrations to a greater degree than is desirable, hence reducing the volume of the desired percussion. With the popularity of clear plastic drumheads, items such as those mentioned, being stuffed into the drum shell, present a totally unacceptable appearance when used in public performance.

It is therefore one of the principal objects of the present invention to provide a drumhead deadening device which can be placed on the inside of a drumhead and will substantially reduce the intensity of vibrations reflected by the rim of the drum, thus substantially decreasing the ringing phenomenon while not interfering with the playing of the drum, and which will present a pleasing appearance when used on transparent drumheads.

Another object of the present invention is to provide a drumhead deadening device which can be attached directly to the drumhead membrane and will stay attached thereto, permitting it to be used with drums carried by marching band members and the like, and which can be attached quickly, easily and securely, and will stay in place after once having been installed, thus not requiring installation each time the drum is to be used.

A further object of the present invention is to provide a drumhead deadening device which reduces the ringing phenomenon, yet does not substantially interfere with the desired percussive tone, quality and volume of the drum, and which can be used simultaneously on both the attack and resonating heads of dual headed drums.

A still further object of the present invention is to provide a drumhead deadening device which can be manufactured in a variety of sizes, can be manufactured inexpensively, and in a manner to provide ready installation of the device, and which can be produced in a variety of shapes, designs and colors, thus providing unique visual appearances when used on transparent drumheads.

Further objects and advantages of the present invention will be apparent from the following detailed description and the accompanying drawings, wherein:

FIG. 1 is a perspective view of a dual headed drum having drumhead deadening devices embodying the present invention, showing one installed on each drumhead membrane;

FIG. 2 is a vertical cross sectional view of the drum shown in FIG. 1, the cross section taken on line 2—2 of the latter figure;

FIG. 3 is a plan view of one of the drumheads shown in FIG. 1;

FIG. 4 is a plan view of a drumhead with a modified form of drumhead deadening device;

FIG. 5 is a vertical cross sectional view of a drumhead deadening device prior to installation on a drumhead membrane; and FIG. 6 is an enlarged vertical cross sectional view of the drumhead deadening device shown in FIG. 4, taken on line 6—6 of the latter figure.

Referring more specifically to the drawings, and to FIG. 1 in particular, numeral 10 designates a dual headed drum which has drumhead deadening devices 12 and 14 embodying the present invention installed thereon to absorb reflected drum vibrations and to reduce the ringing phenomenon. Drum 10 is a conventional drum structure having an upper or attack head 16 and a lower or resonating head 18. The basic structure of attack head 16 consists of an outer rim 20, a drumhead membrane 22 attached thereto, and a preferred attack area 24 in the center of membrane 22. Resonating head 18 consists essentially of an outer rim 30 and a resonating membrane 32. Membranes 22 and 32 are of plastic, such as nylon or other synthetic material commonly used in drumheads. The drumhead deadening device of the present invention can also be used on calfskin or other "natural" drum membranes; however, since the ringing phenomenon is much less severe in drums with non-synthetic membranes, the device is not usually required on them. Although a dual headed drum structure is depicted in the drawings, the drumhead deadening device works equally well on single headed drums and on drums of all sizes. A drum shell 34 is disposed between attack head 16 and resonating head 18, and a plurality of tensioning devices 35 are used to provide appropriate tension to the drumheads.

Drumhead deadening devices 12 and 14, attached respectively to attack head 16 and resonating head 18, are similar in construction, having an annular body 40 of foam rubber, polyester, or other suitable porous and pliable material attached to the drumhead membrane by an adhesive layer 42 of contact cement, or other permanent type adhesive suitable for adhering foam rubber and plastic or nylon to plastic material. Device 12 is positioned so that the inner opening thereof, indicated generally by numeral 44, is positioned directly beneath the preferred attack area 24 of attack head 16; hence, the device does not perceptibly interfere with the originating vibrations induced by beating of the drum, and the annular ring of foam rubber vibrates with the intense originating vibrations moving outwardly through the drumhead membrane. While the ring effectively eliminates or minimizes the objectionable ringing sound, the manner in which it accomplishes this is not entirely clear or fully understood. However, it is believed that the return vibrations, which are reflected from rim 20, are less intense than the original vibrations and are absorbed by device 12. Device 14, which is attached to resonating head 18, functions similarly to device 12 on attack head 16. The originating vibrations of resonating head 18 are caused by conductance of the sound waves created by attack head 16. The less intense, reflected vibrations are absorbed by deadening device 14, but the more intense originating vibrations traveling outwardly through membrane 32 are not significantly diminished by the device.

FIG. 4 shows a modified form of drumhead deadening device which has a star shaped body 50, and a circular opening 52 centrally located therein. A decorative drumhead deadening device, such as that shown in FIG. 4, is often desirable when used on a clear plastic drumhead through which the device is clearly visible. The device can also be produced in other shapes, such as squares, triangles, rectangles and the like, as well as in a variety of colors to correspond with the color of the drum walls or to coordinate with the color scheme of the band; however, the various shapes have an opening at the center in the proximity of the drumhead attack area. An adhesive layer is used to attach the devices to the inner side of the head, and they function similarly to those previously described. The device can be produced in any size necessary to function efficiently on any size drum, from large bass drums to smaller marching drums. The drumhead deadening device can be efficiently manufactured from large sheets of foam rubber on which the adhesive layer 42 is applied and a protective peel-away paper layer 54 is placed over the adhesive layer. Any desired form can be stamped or otherwise cut out of the large sheet of foam rubber, and, if cut into an annular ring shape, little or no waste results, as progressively smaller rings can be cut from the center portion which was removed from the preceding larger rings. The paper layer protects the adhesive layer during packing, shipping, and storing of the device, yet is readily removable when the device is to be installed. In place of this pre-applied adhesive, liquid adhesives applied directly to the device or inner drumhead surfaces may be used, if desired, to secure the device to the drumhead.

In the use and operation of a drumhead deadening device embodying the present invention previously described herein, the paper layer 54 is peeled from the adhesive layer 42 and the device is positioned on the drumhead membrane so that the center opening 44 of the device corresponds with the preferred attack area 24 of the drumhead. If the drum has a resonating head, a second drumhead device may be attached to it as well. The devices will adhere readily to the synthetic membranes if suitable adhesives are used, such as those commonly employed on bumper stickers and the like. The device will remain permanently attached and function effectively on drums being carried as well as on stationary drums. When the drum is struck by the drummer, the originating vibrations travel outwardly toward the rim of the drum and, since the open area 44 is located directly below the preferred attack area, little or no interference with the relatively intense originating vibrations is created; hence, optimum tone quality and volume are achieved from the beating of the drum. In theory, the reflected vibrations which return toward the center of the drumhead are substantially less intense, and are absorbed by the deadening device and do not interfere with the originating vibrations traveling outwardly caused by the successive drum beats. Thus, the ringing phenomenon is eliminated or substantially reduced, since there is little or no interference between reflected vibrations and originating vibrations. Once installed, the device will remain on the drumhead and need not be installed for each playing engagement. The materials of the device are inherently light weight and add no discernible weight to the drum and will not increase the fatigue factor for marching drummers. The variety of colors and shapes in which the device can be produced makes the device desirable for transparent drumheads.

Although only one embodiment and several modifications thereof have been described in detail herein, other changes may be made without departing from the scope of the present invention.

I claim:

1. A drumhead structure comprising a drumhead membrane, an outer rim disposed on the periphery of said membrane, a device of porous, pliable material for absorbing some of the vibrations of said membrane, an opening therein to correspond in position to the preferred attack area of said membrane, and an adhesive attaching said device to said membrane.

2. A drumhead structure as defined in claim 1 in which said device is in one of the following shapes: rectangular, triangular, circular or star shaped.

3. A drumhead structure as defined in claim 1 in which said device is made of foam rubber.

4. A drumhead structure as defined in claim 1 in which said device is made of polyester.

5. A drumhead structure as defined in claim 1 in which said device is in an annular shape.

6. A drum with a drumhead deadening device, comprising a drumhead membrane, an outer rim disposed on the periphery of said membrane, a device of porous, pliable material for absorbing some of the vibrations of said membrane, an opening therein to correspond in position to the preferred attack area of said membrane and an adhesive attaching said device to said membrane.

7. A drum with a drumhead deadening device as defined in claim 6 in which a layer of said adhesive is disposed on one surface of said device.

8. A drum with a drumhead deadening device as defined in claim 7 in which said device is made of foam rubber.

* * * * *